US009620306B2

(12) United States Patent
Huang

(10) Patent No.: US 9,620,306 B2
(45) Date of Patent: Apr. 11, 2017

(54) MAGNETIC KEYBOARD

(71) Applicant: Primax Electronics Ltd., Neihu, Taipei (TW)

(72) Inventor: Wei-Yung Huang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 13 days.

(21) Appl. No.: 14/801,005

(22) Filed: Jul. 16, 2015

(65) Prior Publication Data

US 2016/0329172 A1 Nov. 10, 2016

(30) Foreign Application Priority Data

May 8, 2015 (TW) ..... 104114785 A

(51) Int. Cl.
*H01H 13/70* (2006.01)
*H01H 13/7065* (2006.01)
*H01H 5/02* (2006.01)

(52) U.S. Cl.
CPC ..... *H01H 13/7065* (2013.01); *H01H 5/02* (2013.01); *H01H 2215/042* (2013.01); *H01H 2221/04* (2013.01); *H01H 2221/066* (2013.01)

(58) Field of Classification Search
CPC ..... H01H 5/02; H01H 2221/04; H01H 2221/048; H01H 2221/022; H01H 2215/042
See application file for complete search history.

(56) References Cited

U.S. PATENT DOCUMENTS 3,815,066 A * 6/1974 Vinal ..... H03K 17/90 200/404
4,054,944 A * 10/1977 Lau ..... H01H 5/02 200/5 E
5,977,888 A * 11/1999 Fujita ..... H01H 13/705 200/12
9,018,554 B2 * 4/2015 Chen ..... H01H 13/83 200/310
9,224,553 B2 * 12/2015 Chiang ..... H01H 13/705

* cited by examiner

*Primary Examiner* — Felix O Figueroa

(74) *Attorney, Agent, or Firm* — Kirton McConkie; Evan R. Witt

(57) ABSTRACT

A magnetic keyboard includes a base, a switch circuit board and plural keys. Each key includes a keycap, plural first magnetic elements and plural second magnetic elements. The switch circuit board is disposed on the base. The plural keys are connected with the base. The plural first magnetic elements of each key are fixed on an inner surface of the keycap. The plural second magnetic elements are disposed within the base. The first magnetic elements are partially inserted into the corresponding second magnetic elements. Consequently, the keys are connected with the base, and the function of returning the keycaps to their original positions are achievable.

7 Claims, 3 Drawing Sheets

MAGNETIC KEYBOARD

FIELD OF THE INVENTION

The present invention relates to a keyboard, and more particularly to a magnetic keyboard.

BACKGROUND OF THE INVENTION

A keyboard is one of the widely-used computer peripheral devices. Generally, the keyboard comprises plural keys. Via the keys, the user can input characters or symbols. The operating principle of the keyboard will be illustrated as follows. When the keys are pressed by the user, the keys are moved downwardly to trigger the keyboard to generate various signals, and the signals are transmitted to a host of the computer. Moreover, when the keys are no longer pressed, the keys are moved upwardly and returned to their original positions.

Conventionally, a membrane keyboard is equipped with scissors-type supporting elements and elastic elements under the keys. Since the pressing force applied to the keycap is distributed uniformly by the scissors-type supporting element, the scissors-type supporting element can stabilize the keycap. Moreover, the key is fixed on a base of the keyboard through the scissors-type supporting element. The elastic element can support the keycap. Moreover, in response to a restoring force of the elastic element, the pressed key is returned to its original position.

However, since the key structure of the conventional keyboard has so many components and the process of assembling the key structure is complicated, the material cost and labor cost are high. Moreover, if any single key is damaged, it is difficult to replace the damaged key with a new one.

Therefore, there is a need of providing an improved keyboard in order to overcome the above drawbacks.

SUMMARY OF THE INVENTION

An object of the present invention provides a magnetic keyboard with plural magnetic keys in order to overcome the drawbacks of the conventional technologies. The magnetic keys are magnetically attracted by the keyboard without the assistance of other connecting elements. Consequently, the assembling complexity and the fabricating cost are reduced, and any single key is detached from the keyboard easily.

In accordance with an aspect of the present invention, there is provided a magnetic keyboard. The magnetic keyboard includes a base, a switch circuit board and plural keys. The switch circuit board is disposed on the base. When the switch circuit board is triggered, a corresponding key signal is generated. The plural keys are connected with the base. Each of the plural keys includes a keycap, plural first magnetic elements and plural second magnetic elements. The plural first magnetic elements are connected with an inner surface of the keycap. Each of the first magnetic elements has an upper portion and a lower portion. The upper portion and the lower portion of the first magnetic element have opposite poles. The plural second magnetic elements are connected with the base. Each of the second magnetic elements has an upper portion and a lower portion. The upper portion and the lower portion of the second magnetic element have opposite poles. The upper portion of the first magnetic element and the upper portion of the second magnetic element have like poles. The lower portion of the first magnetic element and the lower portion of the second magnetic element have like poles. The first magnetic element is inserted into the second magnetic element, so that the lower portion of the first magnetic element is magnetically attracted by the upper portion of the second magnetic element.

In the magnetic keyboard of the present invention, the upper portion and the lower portion of the first magnetic element and the upper portion and the lower portion of the second magnetic element are attracted by or repelled from each other. Consequently, the key is fixed on the keyboard and movable upwardly or downwardly to trigger the generation of the key signal or return the key to its original position. Moreover, since the keycap of the key is easily detached, the assembling complexity is reduced and the keyboard is easily maintained.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiment and accompanying drawings.

Figure 1:
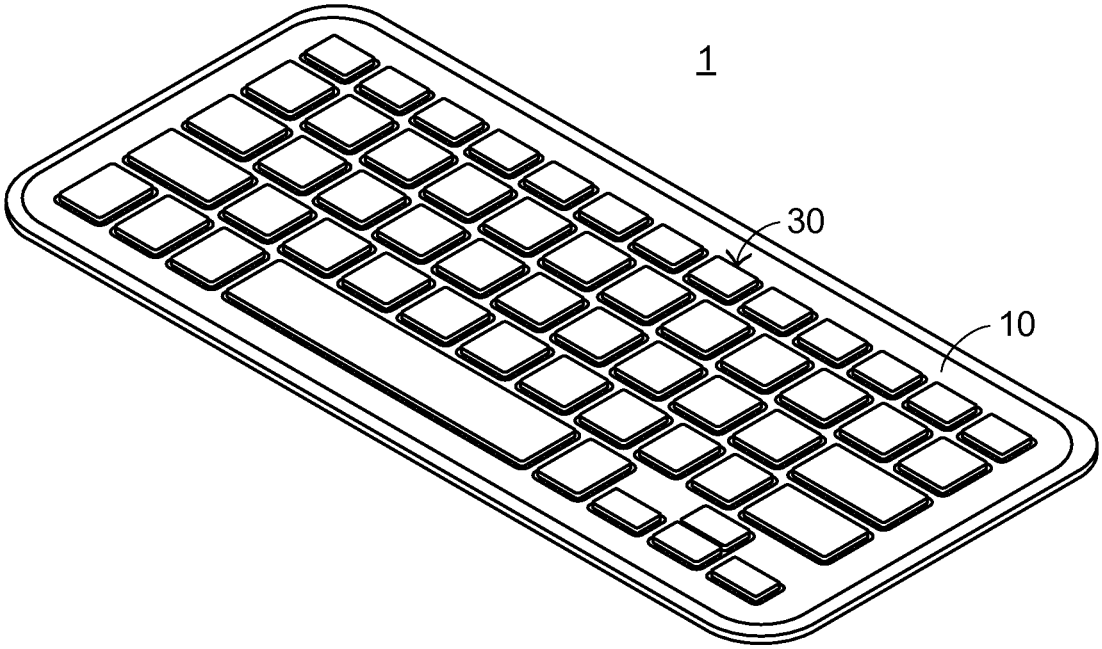
FIG. 1 is a schematic perspective view illustrating the appearance of a magnetic keyboard according to an embodiment of the present invention.

FIG. 1 is a schematic perspective view illustrating the appearance of a magnetic keyboard according to an embodiment of the present invention. As shown in FIG. 1, the magnetic keyboard 1 comprises a base 10 and plural keys 30. When one of the keys 30 is pressed by the user, a corresponding input command is generated. For well understanding the technologies of the present invention, a single key 30 and the associated assembled structure will be illustrated as follows.

Figure 2:
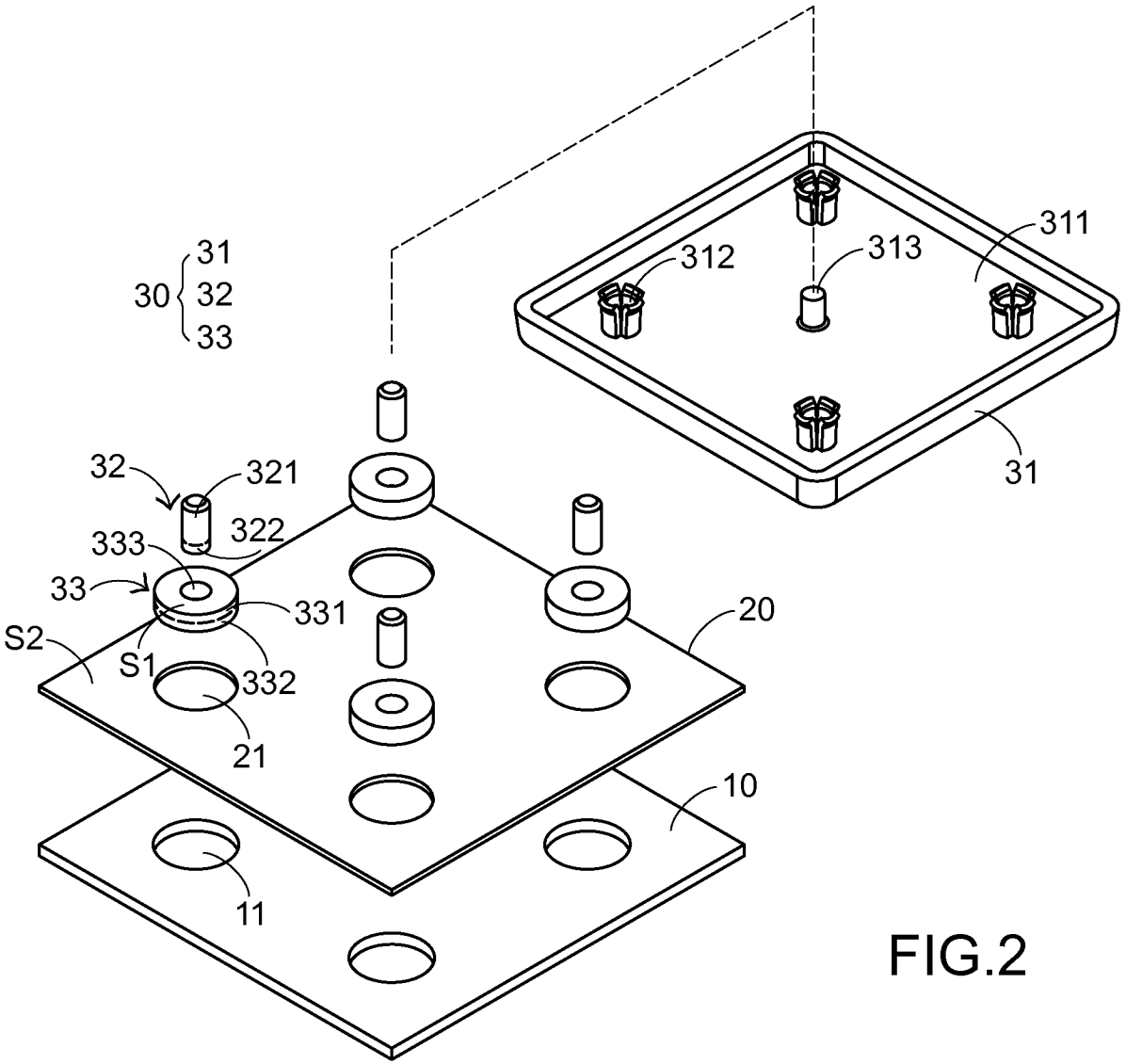
FIG. 2 is a schematic exploded view illustrating a key of the magnetic keyboard according to an embodiment of the present invention.

FIG. 2 is a schematic exploded view illustrating a key of the magnetic keyboard according to an embodiment of the present invention. As shown in FIG. 2, the magnetic keyboard 1 comprises the base 10, a switch circuit board 20 and plural keys 30. The switch circuit board 20 is disposed on the base 10. The plural keys 30 are connected with the base 10. In this embodiment, the key 30 comprises a keycap 31, plural first magnetic elements 32 and plural second magnetic elements 33. The keycap 31 is disposed over the switch circuit board 20. The plural first magnetic elements 32 are connected with an inner surface 311 of the keycap 31. The plural second magnetic elements 33 are connected with the base 10. Each of the first magnetic elements 32 has an upper portion 321 and a lower portion 322. The upper portion 321 and the lower portion 322 have opposite poles. Each of the second magnetic elements 33 has an upper portion 331 and a lower portion 332. The upper portion 331 and the lower portion 332 have opposite poles. Moreover, the upper portion 321 of the first magnetic element 32 and the upper portion 331 of the second magnetic element 33 have like poles, and the lower portion 322 of the first magnetic element 32 and the lower portion 332 of the second magnetic element 33 have like poles. Moreover, the second magnetic element 33 further comprises a perforation 333. The perforation 333 runs through the upper portion 331 and the lower portion 332 of the second magnetic element 33. The first magnetic element 32 is partially inserted into the perforation 333 of the second magnetic element 33. Consequently, the lower portion 322 of the first magnetic element 32 is magnetically attracted by the upper portion 331 of the second magnetic element 33.

In an embodiment, the base 10 is a square flat plate. Preferably but not exclusively, the base 10 is made of a metallic material or a plastic material. Preferably, the switch circuit board 20 is a membrane switch circuit board. The switch circuit board 20 is disposed on a top surface of the base 10. In this embodiment, the membrane switch circuit board 20 has a three-layered structure for generating a key signal. The plural keys 30 are disposed over the switch circuit board 20. When one of the keys 30 is pressed by the user, the switch circuit board 20 is triggered to generate the corresponding key signal.

Moreover, the switch circuit board 20 further comprises plural first openings 21 corresponding to the plural keys 30. The plural second magnetic elements 33 are partially accommodated within the corresponding first openings 21. The base 10 further comprises plural second openings 11 corresponding to the plural first openings 21 and the plural keys 30. After the plural second magnetic elements 33 are penetrated through the corresponding first openings 21, the plural second magnetic elements 33 are partially accommodated within the corresponding second openings 11. After the plural second magnetic elements 33 are accommodated within the first openings 21 and the second openings 11, the top surfaces S1 of the plural second magnetic elements 33 are at the same level with the top surface S2 of the switch circuit board 20 (see FIG. 3).

In addition to the keycap 31, the plural first magnetic elements 32 and the plural second magnetic elements 33, the key 30 further comprises plural clamping structures 312 and a protrusion 313. The plural clamping structures 312 and a protrusion 313 are disposed on the inner surface 311 of the keycap 31. The inner surface 311 of the keycap 31 faces the base 10. In this embodiment, the keycap 31 comprises four clamping structures 312. The four clamping structures 312 are fixed on four corners of the inner surface 311 of the keycap 31, respectively. Preferably, the clamping structures 312 are integrally formed with the keycap 31. After the first magnetic elements 32 are fixed by the corresponding clamping structures 312, the first magnetic elements 32 are connected with the keycap 31. Moreover, when the keycap 31 is pressed by the user, the protrusion 313 is moved downwardly to trigger the switch circuit board 20 so as to generate the corresponding key signal.

Figure 3:
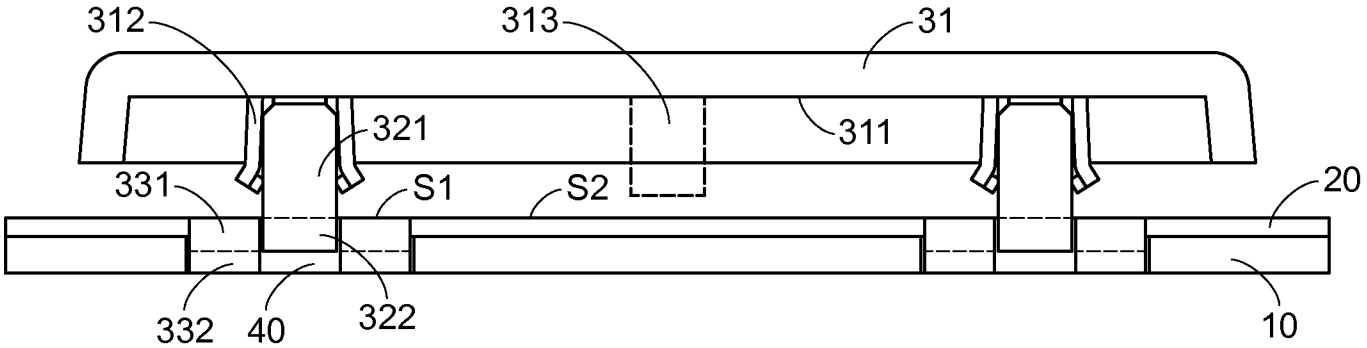
FIG. 3 is a schematic cross-sectional view illustrating the magnetic keyboard according to an embodiment of the present invention, in which the key is not pressed.
Figure 4:
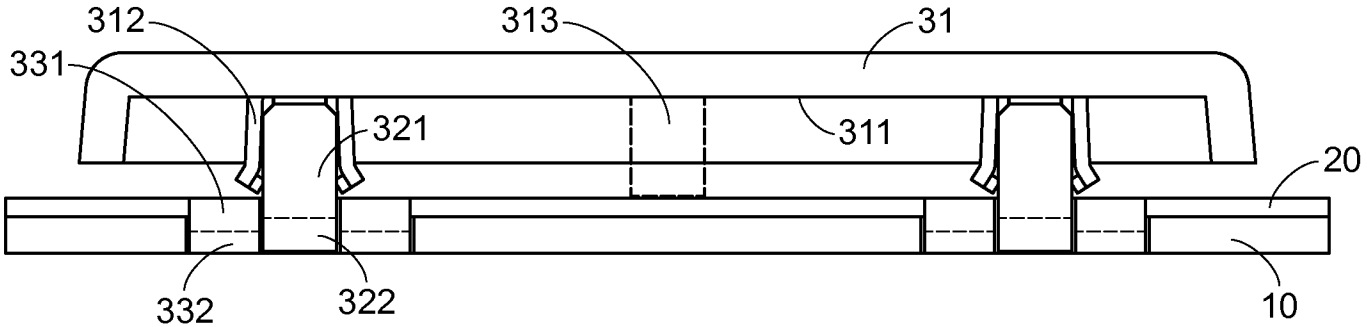
FIG. 4 is a schematic cross-sectional view illustrating the magnetic keyboard according to an embodiment of the present invention, in which the key is pressed.

Hereinafter, the relationship between the components of the key 30 and the operating mechanism of the key 30 will be illustrated with reference to FIGS. 3 and 4. FIG. 3 is a schematic cross-sectional view illustrating the magnetic keyboard according to an embodiment of the present invention, in which the key is not pressed. FIG. 4 is a schematic cross-sectional view illustrating the magnetic keyboard according to an embodiment of the present invention, in which the key is pressed.

Please refer to FIG. 3. The first magnetic elements 32 are partially inserted into the perforations 333 of the corresponding second magnetic elements 33. As mentioned above, the lower portion 322 of the first magnetic element 32 and the upper portion 331 of the second magnetic element 33 have opposite poles. Since opposite poles attract each other, the lower portion 322 of the first magnetic element 32 is magnetically attracted by the upper portion 331 of the second magnetic element 33 when the first magnetic element 32 is inserted into the perforation 333 of the second magnetic element 33. In particular, the first magnetic element 32 is suspended in the perforation 333, and a buffer space 40 is formed under a bottom surface of the first magnetic element 32. While the key 30 is pressed or the key 30 is returned to its original position, the first magnetic element 32 is vertically movable within the perforation 333 because of the buffer space 40.

Please refer to FIG. 4. When the key 30 is pressed by the user, an external force is applied to the keycap 31 and the first magnetic elements 32 are moved with the keycap 31. Consequently, the bottom surface of each first magnetic element 32 of the key 30 is moved toward the bottom of the buffer space 40. Meanwhile, the lower portion 322 of the first magnetic element 32 and the lower portion 332 of the second magnetic element 33 have like poles. Since like poles repel each other, a repelling force is generated by the lower portion 322 of the first magnetic element 32 and the lower portion 332 of the second magnetic element 33. When the key 30 is no longer pressed, the first magnetic element 32 is moved upwardly in response to the repelling force. Until the lower portion 322 of the first magnetic element 32 is magnetically attracted by the upper portion 331 of the second magnetic element 33 again, the keycap 31 is returned to its original position (see FIG. 3).

From the above descriptions, the plural first magnetic elements 32 are fixed on the inner surface 311 of the keycap 31, and the second magnetic elements 33 are fixed on the base 10. By the plural first magnetic elements 32 and the second magnetic elements 33, the key 30 is directly fixed on the base 10. Moreover, after the key 30 is pressed, the key 30 is returned to its original position by the plural first magnetic elements 32 and the second magnetic elements 33. Under this circumstance, the key 30 can be fixed on the magnetic keyboard 1 without the connecting element, and the keycap 31 can be returned to its original position without the support of the elastic element. Consequently, the assembling complexity and the material cost are reduced. Moreover, the keys of the magnetic keyboard of the present invention can be easily detached so as to be cleaned and replaced. In conclusion, the magnetic keyboard of the present invention is more advantageous over the conventional keyboard.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A magnetic keyboard, comprising:

a base;

a switch circuit board disposed on the base, wherein when the switch circuit board is triggered, a corresponding key signal is generated; and plural keys connected with the base, wherein each of the plural keys comprises:

a keycap;

plural first magnetic elements connected with an inner surface of the keycap, wherein each of the first magnetic elements has an upper portion and a lower portion, and the upper portion and the lower portion of the first magnetic element have opposite poles; and plural second magnetic elements connected with the base, wherein each of the second magnetic elements has an upper portion and a lower portion, and the upper portion and the lower portion of the second magnetic element have opposite poles, wherein the upper portion of the first magnetic element and the upper portion of the second magnetic element have like poles, and the lower portion of the first magnetic element and the lower portion of the second magnetic element have like poles, wherein the first magnetic element is inserted into the second magnetic element, so that the lower portion of the first magnetic element is magnetically attracted by the upper portion of the second magnetic element, and wherein the switch circuit board further comprises plural first openings corresponding to the plural keys, wherein the second magnetic elements are partially accommodated within the corresponding first openings.

2. The magnetic keyboard according to claim 1, wherein the switch circuit board is a membrane switch circuit board.

3. The magnetic keyboard according to claim 1, wherein the second magnetic element comprises a perforation, and the perforation runs through the upper portion and the lower portion of the second magnetic element, wherein the first magnetic element is partially inserted into the perforation of the second magnetic element.

4. The magnetic keyboard according to claim 1, wherein each of the keys further comprises plural clamping structures, and the plural clamping structures are disposed on the inner surface of the keycap, wherein the keycap is connected with the plural first magnetic elements through the corresponding clamping structures.

5. The magnetic keyboard according to claim 1, wherein each of the keys further comprises a protrusion, and the protrusion is disposed on the inner surface of the keycap, wherein when the keycap is pressed, the switch circuit board is triggered by the protrusion, so that the corresponding key signal is generated.

6. The magnetic keyboard according to claim 1, wherein the base further comprises plural second openings corresponding to the plural first openings and the plural keys, wherein the plural second magnetic elements are accommodated within the corresponding first openings and the corresponding second openings.

7. The magnetic keyboard according to claim 6, wherein a top surface of each second magnetic element is at the same level with a top surface of the switch circuit board.

* * * * *